US007594357B2

(12) United States Patent
Harrington

(10) Patent No.: US 7,594,357 B2
(45) Date of Patent: Sep. 29, 2009

(54) MANUAL LIFT GATE SYSTEM

(75) Inventor: Pat Harrington, Coeur d'Alene, ID (US)

(73) Assignee: Solid Rock Gate Supply, Inc., Coeur D'Alene, ID (US)

( * ) Notice: Subject to any disclaimer, the term of this patent is extended or adjusted under 35 U.S.C. 154(b) by 64 days.

(21) Appl. No.: 11/831,665

(22) Filed: Jul. 31, 2007

(65) Prior Publication Data

US 2008/0184626 A1 Aug. 7, 2008

Related U.S. Application Data

(60) Provisional application No. 60/899,500, filed on Feb. 6, 2007.

(51) Int. Cl.
*E05D 15/06* (2006.01)

(52) U.S. Cl. ..... 49/226; 49/387

(58) Field of Classification Search ..... 49/226, 49/227, 232, 386, 387
See application file for complete search history.

(56) References Cited

U.S. PATENT DOCUMENTS 4,270,312 A * 6/1981 Courtis et al. ..... 49/385
4,381,626 A * 5/1983 Courtis et al. ..... 49/385
4,470,221 A * 9/1984 Courtis ..... 49/385
4,658,543 A * 4/1987 Carr ..... 49/139
4,779,379 A * 10/1988 Steen ..... 49/385
4,887,393 A * 12/1989 Cysewski ..... 49/385
4,986,031 A * 1/1991 Agnew et al. ..... 49/385
5,131,187 A * 7/1992 Agnew et al. ..... 49/385
5,263,281 A * 11/1993 Osborn ..... 49/280
5,299,386 A * 4/1994 Naegelli et al. ..... 49/28
5,398,450 A 3/1995 Cacicedo (Continued)

*Primary Examiner*—Jerry Redman
(74) *Attorney, Agent, or Firm*—Simple IP Law, P.C.; Craig R. Rogers

(57) ABSTRACT

A gate assembly constructed according to principles of the present invention preferably has the ability, with only a small amount of manual force, to open a gate by pivoting the gate upwardly about a pivot point. The gate assembly can include, for instance, a pivot arm to which the gate is attached. The pivot arm preferably pivots at the pivot point about a pivot axis, for instance, using a pin and bearing setup attached to a main frame. A biasing member can provide a biasing force to the gate to maintain the gate in an open or closed position and/or to assist in opening the gate. An adjustment mechanism can be provided to enable adjustment of an amount of the biasing force. When the biasing member is a spring assembly, a spring adjustment sleeve can be slidably arranged on the pivot arm and attached to an end of one or more springs, with a desired number of springs (and spring force) selected depending on the weight of the gate. The slide is preferably configured to move up and down on the pivot arm to change the amount of tension applied by the springs on the arm. An opposite end of the springs is preferably attached to the main frame. Alternatively, or in addition, a spring adjustment member may be attached between the spring and the frame. When in a closed position, the gate assembly is preferably balanced between the force of the spring tension and the weight of the gate. This balance allows the gate to be opened by applying a small amount of force in an upward direction anywhere along the body of the barrier. To close the barrier, a downward force can preferably be applied anywhere along the body of the barrier, with gravity taking over to close the gate once a certain point is reached.

19 Claims, 8 Drawing Sheets

U.S. PATENT DOCUMENTS 5,632,514 A 5/1997 Johnson, Jr.
6,009,670 A * 1/2000 Howard ..... 49/340
6,119,399 A * 9/2000 McCain et al. ..... 49/340
6,655,090 B2 12/2003 Regner
6,796,084 B2 * 9/2004 Gagnon ..... 49/226
6,834,618 B2 12/2004 Pickin et al.

* cited by examiner

MANUAL LIFT GATE SYSTEM

PRIORITY CLAIM

This application is a nonprovisional application of and claims priority from U.S. Provisional Patent Application No. 60/899,500, filed Feb. 6, 2007, the contents of which are incorporated herein by reference in their entirety.

TECHNICAL FIELD

The present invention relates generally to barrier systems, such as walls or fences, and more particularly, to gated openings in such barrier systems.

BACKGROUND OF THE INVENTION

There have been all types of protected barrier openings (or gates), used throughout history. Most gates can be categorized as having one of two common types of movement to clear the path which they protect. These movements are typically either a sliding motion or a swinging motion along a path that is parallel to the ground. In either case, the motion is most often initiated and sustained by some type of human or other mechanical force.

Once in motion, a swing-style gate will pivot, generally parallel to the ground, around a single fixed point to which it is hinged. A sliding gate will slide along a prescribed path, also generally parallel to the ground, guided with the aid of a rail or roller system to which it is attached. Both systems can be employed in a variety of ways. Unfortunately, however, in outside applications each system may experience some difficulties maneuvering around, over, or through certain elements.

Long grass or deep snow, for instance, can impede the path of either a swing-type or sliding-type gate, making it difficult or impossible to operate the gate under such conditions. The presence of these elements or other obstacles can also restrict how close a bottom of the gate can be arranged with respect to the ground, which can result in leaving an area below the barrier open or exposed.

Another difficulty that can be encountered with these movement styles for gates is in the topography of the land surrounding the barrier. The barrier may, for instance, be located at the base of incline where a swing-motion gate would hit the ground in one direction before achieving an open position. On the other hand, a swing-style barrier located at the top of a decline would experience an increase in distance between the gate and the ground when operated toward the decline, making it awkward for a user to operate.

For a sliding gate, the topography must be substantially level along the area of the protected opening and the area where the gate must slide. Some installation conditions do not allow for such a setup and must therefore be modified to accommodate the barrier. This can significantly increase the installation costs.

In a manual application, another issue with these opening styles is the range over which a person must apply and maintain force in order to fully open or close the gate. For both motions, the manual operator (person), must frequently move along almost the entire distance of the opening in the barrier that the gate covers in order to maintain adequate force throughout the opening or closing procedure.

These and other issues make it desirable to find a way to move a gate from a protected barrier opening in such a way that snow, grass, land topography, or other obstacles would not affect the motion of the gate. It would also be desirable to have a gate style that would decrease the range of motion and the amount of force needed for a manual operator to open or close the gate. The present invention fulfills these needs and provides other related advantages.

SUMMARY OF THE INVENTION

A gate assembly constructed according to principles of the present invention enables a gate to rotate upwardly to clear an opening. The gate assembly can include a biasing member capable of supplying the force necessary to sustain the opening and closing motions of the gate with only a minimal initial application of force (activation force). The gate assembly can have the ability, for instance, with only a small amount of manual force, to lift and rotate a gate (for instance, such as a gate from 0 to 14' ft (or longer) in length) vertically and thus remove it from the path.

In one embodiment, the opening and/or closing biasing force can be evenly sustained over the course of gate travel by a system of springs that maintain a balance between the weight of the barrier and the force of the springs. The motion can, for example, be manually-activated or it may be activated by an electrical signal to a motor, a hydraulic cylinder, or other force-producing electrical device.

The system can include a pivot arm to which the gate is attached. This pivot arm preferably pivots at a pivot point about a bottom pivot axis, such as with a pin and bearing setup that is attached to a main frame. A spring adjustment sleeve (slide) can fit around the pivot arm in a sliding relationship. This sleeve is preferably attached to a spring or a series of springs, with the exact number and/or tension of the springs varying depending on the weight of the gate. The slide is preferably moveable up and down on the pivot arm by sliding the springs pull point in either desired direction to change the amount of tension on the arm and thereby provide adequate tension for the weight of the barrier. The springs are also preferably attached to a main frame of the gate on a side opposite the pivot axis. The main frame can be covered in sheet metal, vinyl, or other material to cover the internal components for both safety and aesthetics.

In operation, the gate assembly, when in a closed position, preferably hangs from the pivot arm and maintains its position by having the weight of the gate balanced by the force of the spring tension pulling in the opposite direction. When this balance is maintained, the barrier can be easily opened by applying a small amount of force in an upward direction anywhere along the body of the barrier. Upon applying an appropriate amount of force, the springs will aid with the rotation of the mechanical pivot arm about the bottom pivot axis. The barrier then rotates vertically out of the way and comes to a rest partially inside the main frame work. To close the barrier, force can again be applied anywhere along the body of the barrier, this time in a downward direction. Once a certain point is reached, gravity will take over as the force necessary to close the barrier. If properly balanced, the springs will allow the barrier to rotate downwardly only to a certain predetermined point and then the force of the spring tension, balanced by the weight of the gate, will again hold it in place in its closed position.

In one embodiment, a gate operating mechanism is provided by the gate itself, which is attached to the pivot arm. The spring adjustment slide can be placed around the pivot arm and can be configured to slide up and down the pivot arm to adjust the spring tension. The spring adjustment slide can include, for instance, a piece of all thread held out by angle iron tabs welded to the pivot arm. The all thread can be placed through an oversized hole of a protruding plate affixed to the slide. Nuts can be threaded on the all thread and placed on either side of the plate to enable the slide to move up or down the pivot arm and to secure the slide in a desired position along the pivot arm once the tension of the springs and the weight of the barrier are in balance.

Of course, other types of mechanisms and connections could also be used to provide the biasing force and to provide an adjustment mechanism for configuring an amount of biasing force to be applied to the gate during its opening and closing motions. These mechanisms and connections can further provide the ability to control the amount of force applied to the gate at various points along its course of travel.

In one embodiment, the pivot arm can be configured to pivot upwardly from a downward position and downwardly from an upward position about a bottom pivot axis located at a pivot point. This can be accomplished, for instance, by way of a solid shaft centrally affixed to the bottom of the pivot arm at the desired pivot point and then placed through bearings or a set of bushing attached to the base of a main frame work. Again, of course, other types of mechanisms and connections could be used to enable the gate to pivot about a desired pivot axis.

The pivot arm can be connected to a spring or series of springs via the spring adjustment slide. The main frame work (or frame) can house the spring(s). The springs can be fastened to the frame on a side of the frame opposite (or otherwise separated from) the pivot point. The frame or the gate can have a guide or set of guides to slide the barrier into a central location within the main frame work and to further function as a stop for the gate once it has achieved a full open position. The frame or the gate can also have a set of guides arranged opposite each other on either side of the frame or the gate to maintain a central stance for the bottom of the gate within the main frame work. The frame can be fastened to the ground or base just to the side of the barrier opening which the gate will protect.

Although most elements of this particular embodiment can be made of steel, tube steel, and plate steel, any other suitable material or materials could also be used. In construction, each piece is preferably sized in proportion to the rest of the invention, generally as shown in the accompanying figures. In the case of steel, for instance, the connections can be solid welds or bolt connections. Other connections known within the art are also contemplated, however, as being within the scope of this invention.

BRIEF DESCRIPTION OF THE DRAWINGS

The foregoing and additional objects, features, and advantages of the present invention will become more readily apparent from the following detailed description, made with reference to the accompanying figures, in which.

DETAILED DESCRIPTION

In the following detailed description, reference is made to the accompanying drawings, which form part thereof, and in which are shown, by way of illustration, exemplary embodiments illustrating various principles of the present invention and how it may be practiced.

Figure 1:
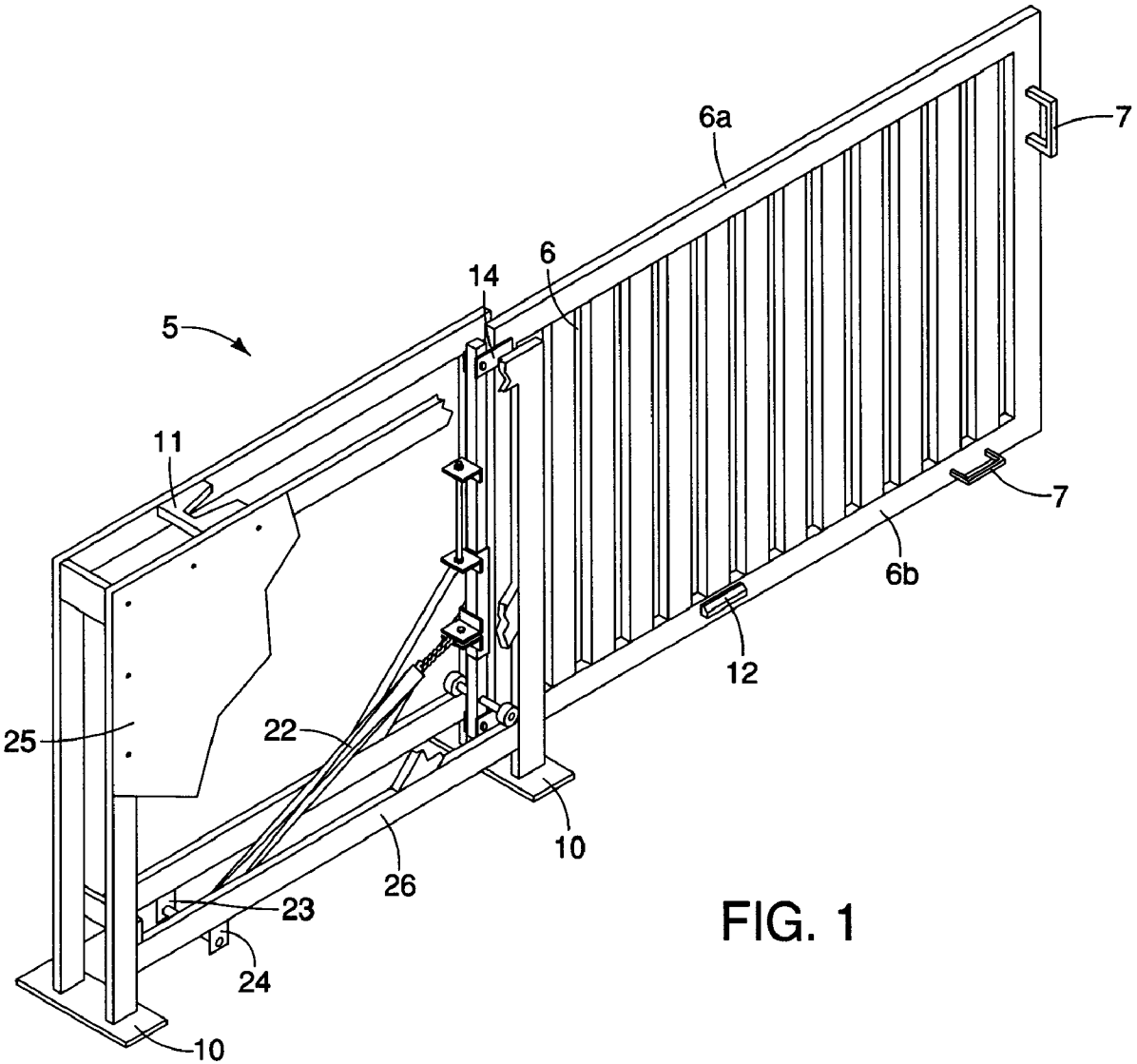
FIG. 1 is a somewhat schematic cutaway perspective view of a gate assembly according to one embodiment of the present invention.
Figure 2:
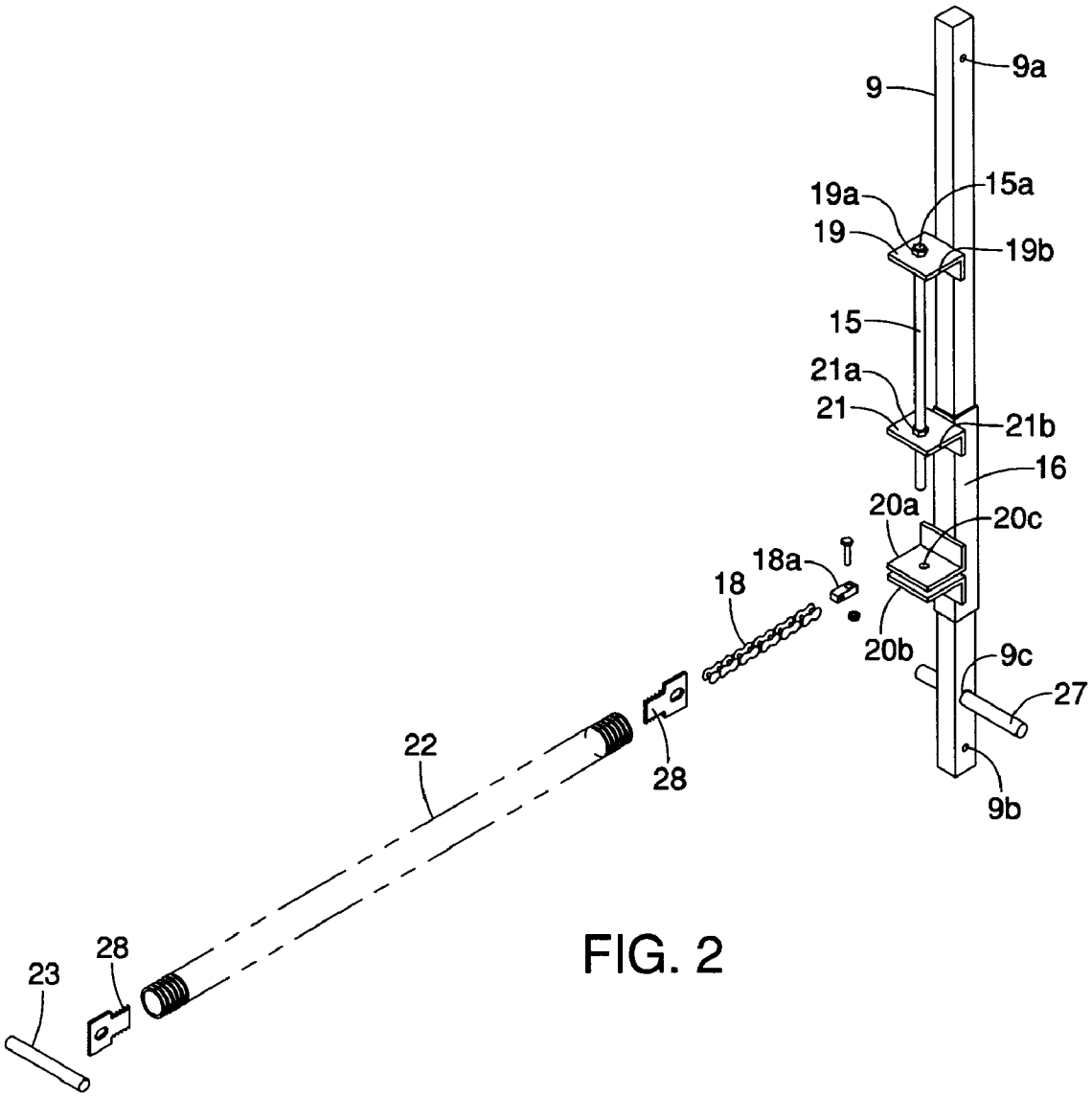
FIG. 2 is a somewhat schematic exploded perspective drawing of a pivot arm and related components as used in the gate assembly of FIG. 1.
Figure 3:
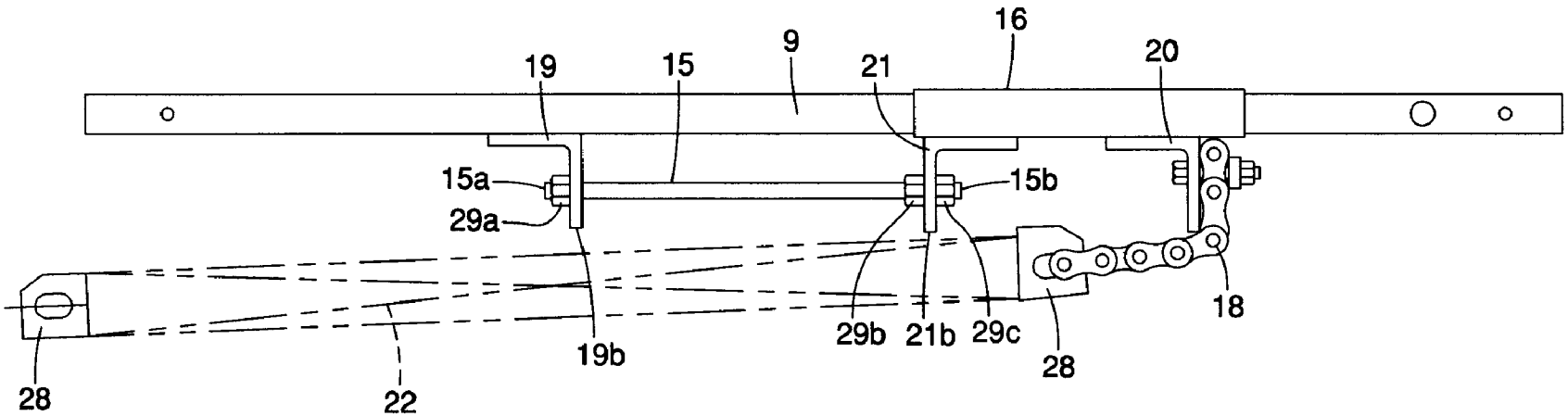
FIG. 3 is a somewhat schematic side view of another embodiment of the pivot arm of FIG. 2, shown in a fully open position.
Figure 4B:
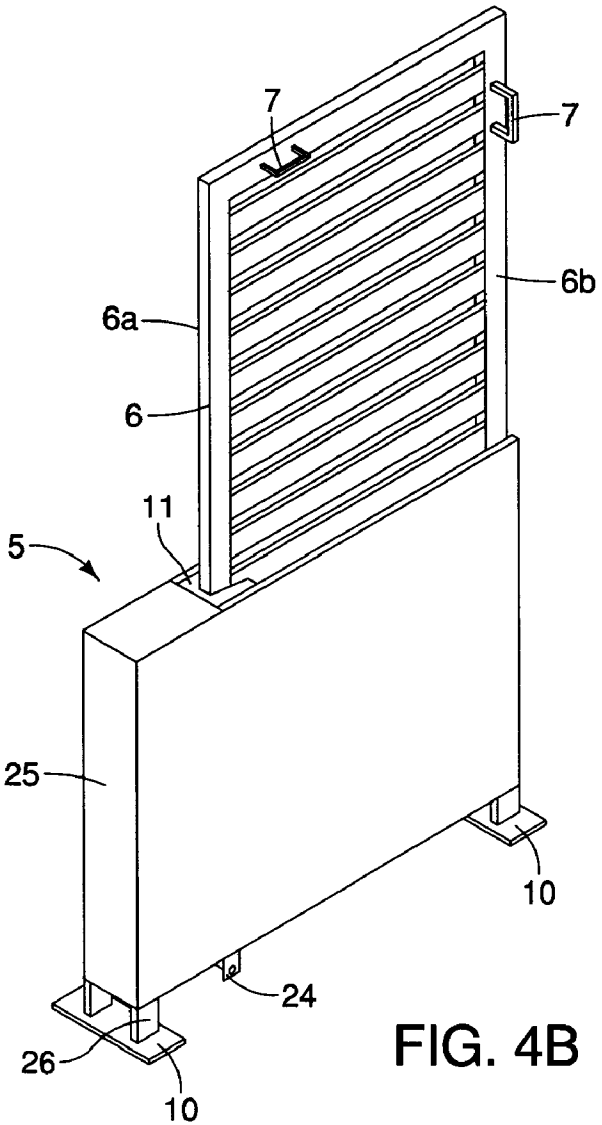
FIGS. 4A and 4B provide two somewhat schematic perspective views of the gate assembly of FIG. 1, illustrating both a fully closed and a fully open position of the gate assembly, respectively.
Figure 4A:
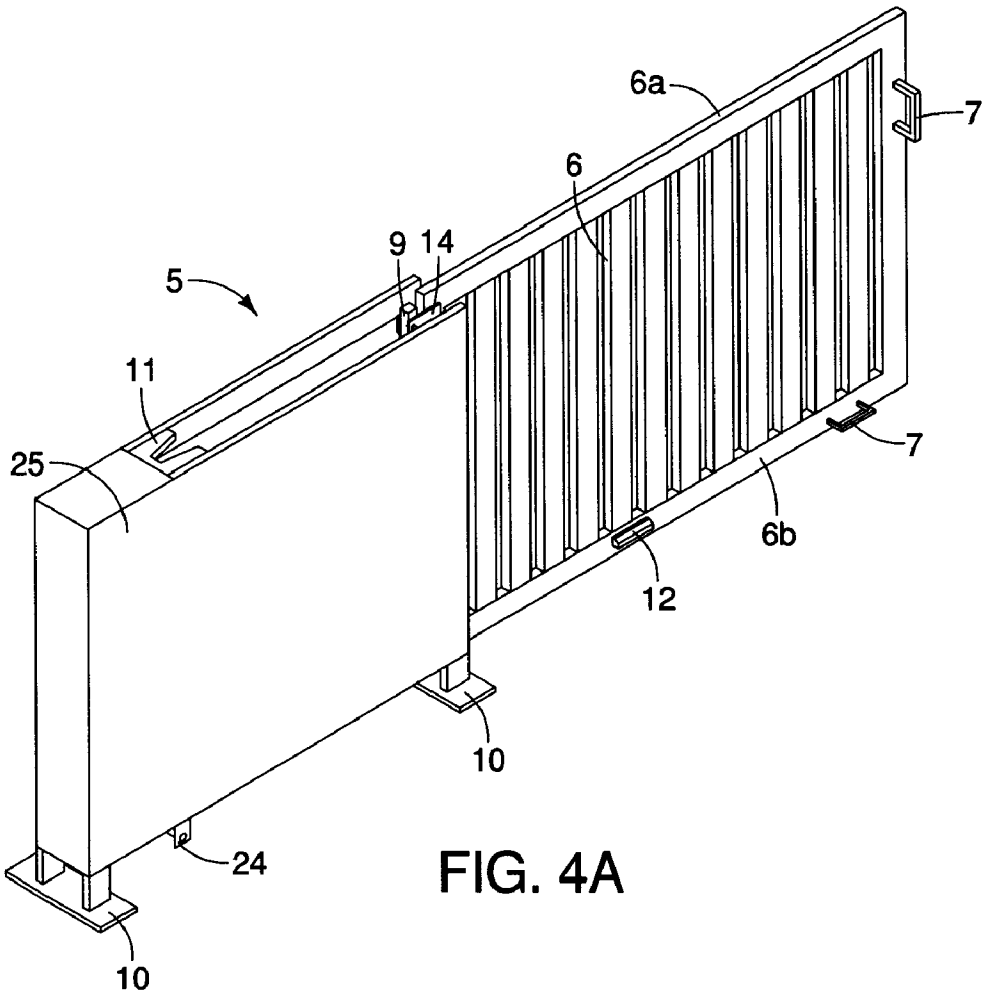

FIG. 1 is a somewhat schematic cutaway perspective view of a gate assembly 5 according to one embodiment of the present invention. FIG. 2 provides a more detailed view of a pivot arm 9 and related components as used in the gate assembly 5 of FIG. 1. FIG. 3 shows an alternative embodiment of the pivot arm 9 assembly in a fully open position. And FIGS. 4A and 4B provide two somewhat schematic perspective views of the gate assembly 5 of FIG. 1, illustrating the gate 6 in both a fully closed and a fully open position, respectively.

Referring to FIGS. 1 through 4B, a gate assembly 5 provides a moveable security barrier. The security barrier shown in this embodiment is a metal wrought-iron gate 6, but the inventive concepts of the present invention can be implemented using any of a variety of materials and designs including, for instance, wood picket, vinyl, or chain-link fencing. The gate 6 can be mounted to the main pivot arm 9 of the gate assembly 5. A plurality of metal plates 14 can, for instance, be welded or bolted to the body of the gate and attached to the pivot arm 9 using bolts of an appropriate size, depending upon the size and weight of the gate 6.

Figure 5:
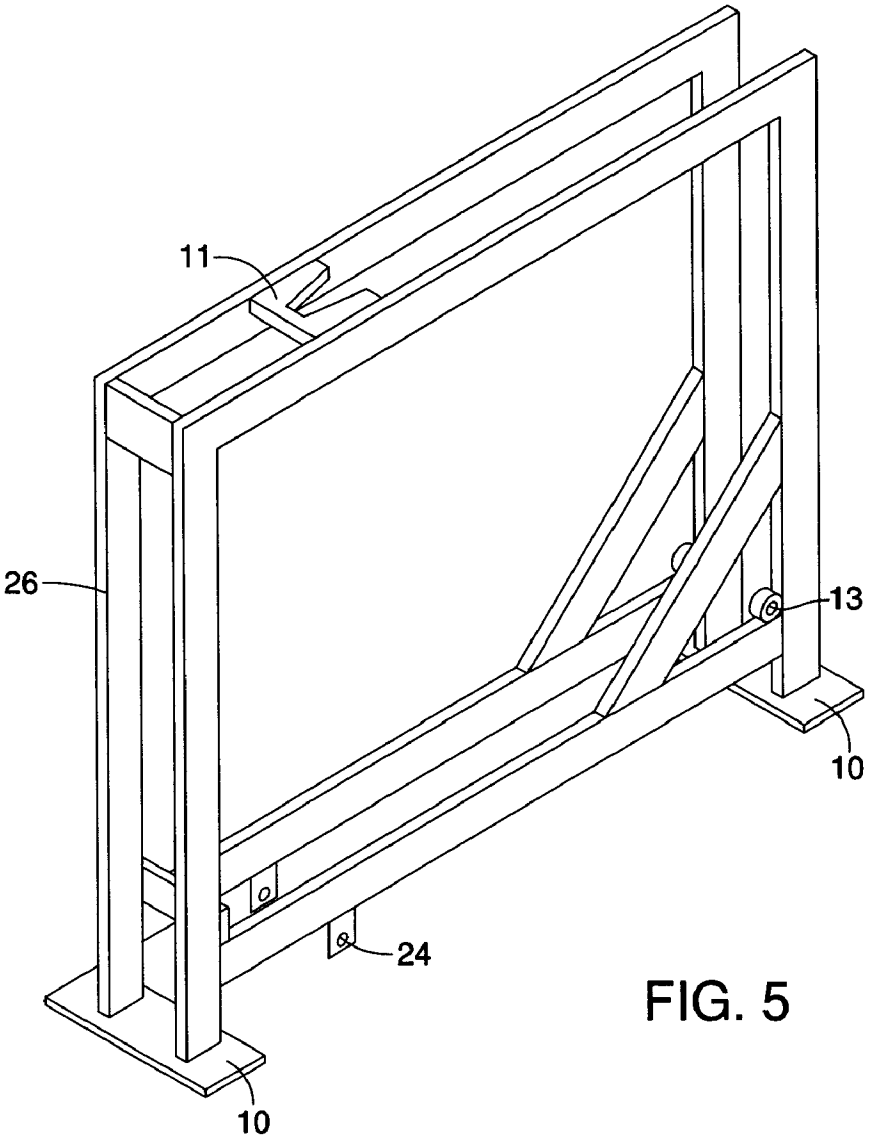
FIG. 5 is a somewhat schematic perspective view of a frame work of the gate assembly of FIG. 1.

The pivot arm 9 can consist of a main piece of steel tubing having a square (or rectangular) cross-section, which is attached in a hinged connection to a main frame work (frame) 26 (depicted in further detail in FIG. 5). The pivot arm 9 preferably has holes 9*a*, 9*b* drilled through its entire width near each end of the steel tube. These holes 9*a*, 9*b* allow the plates 14, attached to the gate 6, to be bolted to the arm 9. A larger hole 9*c* is preferably also drilled through the width of the pivot arm 9, at a position above the bottom hole 9*b*.

The hinged connection between the gate 6 and the frame 26 can, for instance, be provided by a pin 27 and bushing 13 system. Alternatively, however, a standard bearing may replace the bushing 13. The pin 27 is preferably arranged through the hole 9*c* such that an equal amount protrudes out of the arm 9 on either side. The pin 27 can, for instance, be made from steel round stock. The pin 27 can then be solidly attached to the pivot arm 9, such as by welding. The pin and arm assembly is preferably arranged through the two bushings 13, which can be securely welded to the main frame 26. The bushings 13 can comprise a steel sleeve with a piece of round bronze pressed into the tube for wear purposes. The steel round pin 27 can be arranged through a hole in the bronze piece of the bushing 13 to rotate as the gate 6 is lifted and closed. A washer can be welded to the pin 27 on the outside of the bushing as a keeper, to prevent side to side movement of the pin 27.

The pivot arm 9 can further include an angled connection piece 19, which can be a piece of angle iron, for example. The angled piece 19 is secured (e.g., by welding) to a side of the pivot arm 9 that does not include the holes 9*a*, 9*b*, 9*c*. This angled piece 19 preferably has a hole 19*a* formed centrally through a flange 19*b* that extends perpendicular to the arm 9. A piece of all thread 15 can be arranged having one end 15*a* arranged through the hole 19*a*. The all thread 15 can, for instance, be a piece of steel round stock that has been threaded along its entire length or it can simply be threaded for a predetermined distance at each end 15*a*, 15*b*. Other types of adjustment mechanisms could also be used, however, to adjust the location of the adjustment slide 16, and thus the spring connection location, along the pivot arm 29.

After the all thread 15 is placed through the hole 19*a*, a nut 29*a* is preferably placed on the end 15*a* to prevent it from falling all of the way through the hole and to further provide a place for adjustment of the adjustment slide 16. A second nut (not shown) could also be placed on the all thread 15 on an opposite side of the flange 19*b*.

The adjustment slide 16 is preferably arranged on the pivot arm 9 in a sliding relationship. The adjustment slide 16 can, for instance, be a piece of steel tubing with a slightly larger cross-sectional opening (ID) than the outside perimeter (OD) of the arm 9, such that the slide 16 can thereby be placed in a sliding relationship around the arm 9. The slide 16 preferably has an angled piece 21 attached to it that is similar to the angled piece 19 arranged on the arm 9. Also similar to the angled piece 19, the angled piece 21 preferably includes a hole 21*a* formed through a flange 21*b* extending perpendicular from the slide 16. An opposite end 15*b* of the all thread 15 can then be placed through this hole 21*a*. A pair of nuts 29*b*, 29*c* are preferably threaded onto the all thread 15 on opposite sides of the flange 21*b*.

Two additional angled pieces 20*a*, 20*b* can also be affixed (e.g., welded) proximal to each other on the slide 16, preferably in an opposing relationship with a gap between them. The gap is preferably large enough to receive a connecting piece 18*a* for the chain 18. These angled pieces 20*a*, 20*b* also preferably have a common hole 20*c* drilled through both of them. The connecting piece 18*a* of the chain 18 can then be placed between the angled pieces 20*a*, 20*b* and a bolt can be arranged through the hole 20*c* and the connecting piece 18*a* to connect the slide 16 to the chain 18. Alternatively, as shown in FIG. 3, the chain can be directly connected to a single angle piece 20. Again, of course, any other mechanism for connecting the spring to the slide adjustment mechanism 16 is also within the contemplation of this invention.

The chain 18 is preferably connected to a spring 22 via a connector 28. The other end of the spring 22 can be attached to another connector 28. The connectors 28 preferably include a hole formed therethrough to connect to the chain 18 or a steel pin 23. The steel pin 23 is preferably arranged through, and affixed to, two connecting members 24 on the main frame 26.

Referring now specifically to FIGS. 4A and 4B, in operation, the gate 6 is raised and rotated from its closed position (shown in FIG. 4A), out of the way of the barrier opening, by lifting up on one or more of the handles 7. The gate 6, through its connection to the pivot arm 9, is hinged to the main frame work (or box) 26. With the assistance of the biasing force provided by the tension of the spring 22, the gate preferably rotates smoothly and gently into the box 26 and comes to rest against the stop 11. The stop 11 is preferably connected to the main frame 26 to receive the gate 6 in its full up position (as shown in FIG. 4B) and position it centrally between the walls of the frame 26.

In the full up position, the top 6*a* of the gate 6 is preferably supported by the wedge shaped notch in the stop 11, while the bottom 6*b* of the gate 6 is preferably supported in the frame 26 by wedges 12 connected to opposing sides of the bottom 6*b* of the gate 6. The stop 11 on the frame 26 and the wedges 12 on the gate 6 keep the gate 6 properly oriented in a square and straight position while in the gate 6 is up (open).

While in the down (closed) position, the gate is 6 is preferably held in place by the tension of the spring 22. The tension can be adjusted to compensate for the weight of the gate 6 by adjusting the position of the slide 16 on the pivot arm 9. More specifically, by moving the nuts 29*b*, 29*c* on the all thread 15 up or down in relation to the angle piece 21 on the slide 16, the tension of the spring 22 can be increased or decreased. In one configuration, the proper tension of the spring 22 can be such that the gate "floats" inches from the ground and level with the box 26, with the spring 22 providing enough tension that with less than approximately 5 lbs. of force, the gate rotates vertically in a smooth and steady motion and comes to rest in the box 26 against the stop 11. The entire apparatus can be secured to the ground through the main frame 26 by way of metal pads 10 which can, for example, be either bolted to concrete or welded to metal concrete imbeds.

Figure 6:
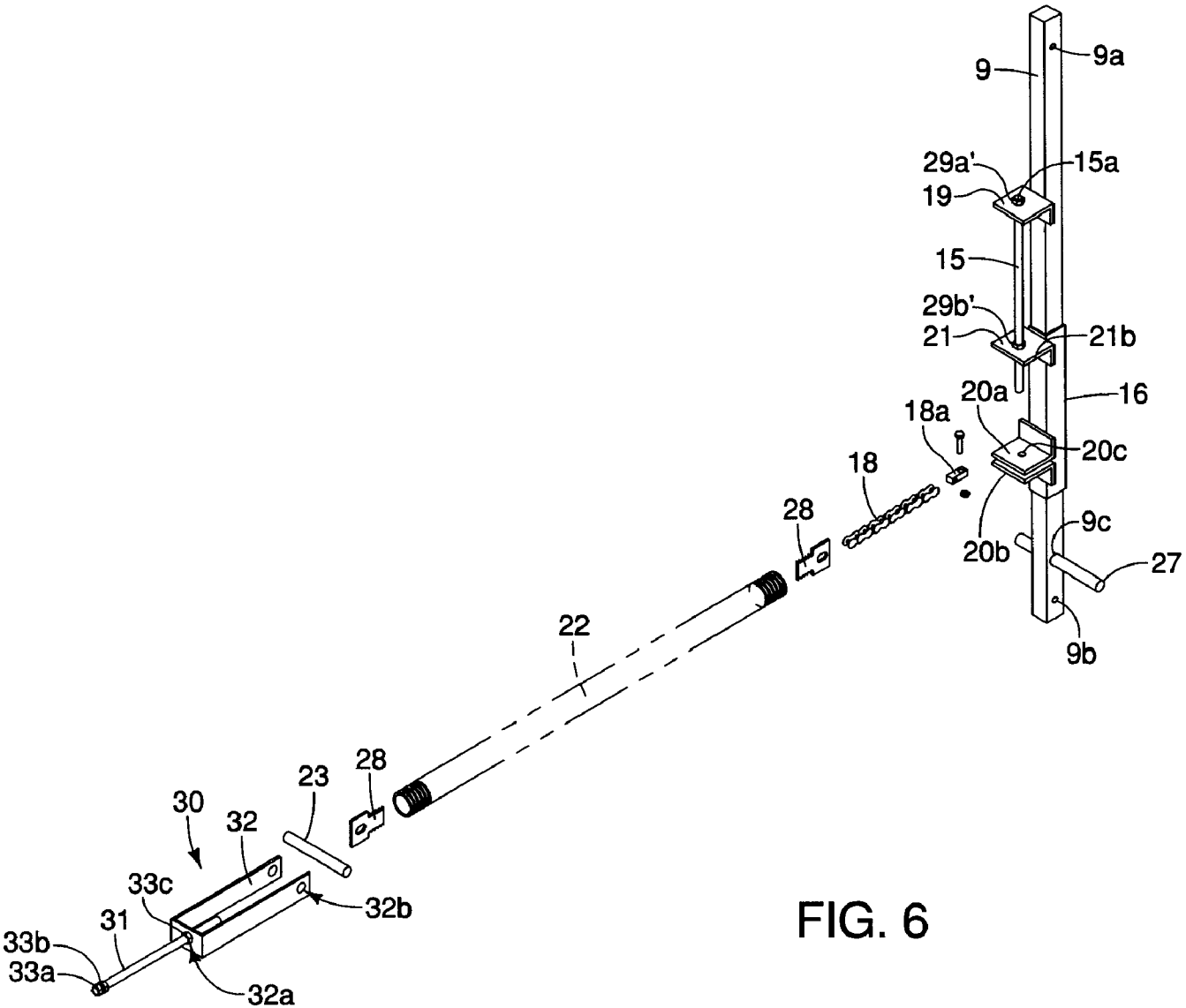
FIG. 6 is a somewhat schematic exploded perspective drawing of a pivot arm and related components, having a slide adjustment mechanism and a spring adjustment mechanism according to another embodiment of the present invention.
Figure 7:
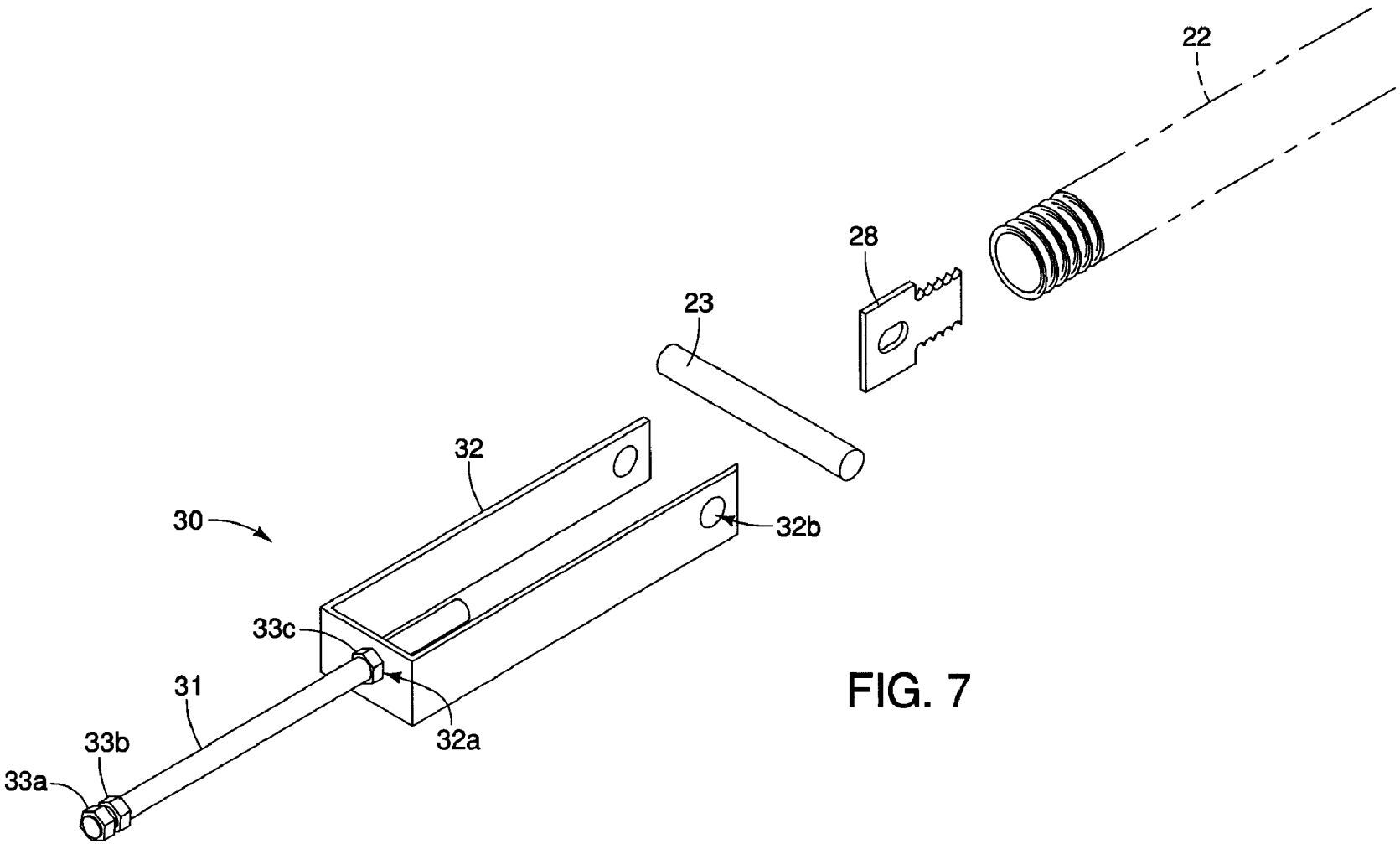
FIG. 7 is a somewhat schematic enlarged exploded perspective view of the spring adjustment mechanism shown in FIG. 6.
Figure 8:
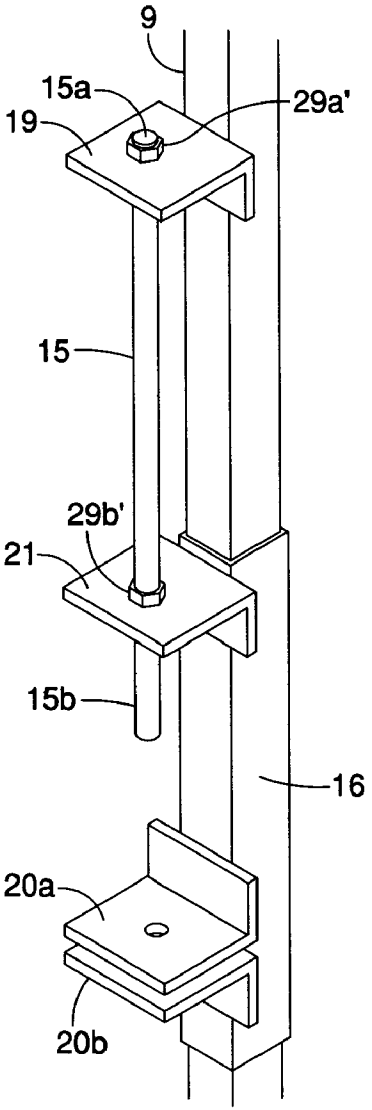
FIG. 8 is a somewhat schematic enlarged perspective view of the slide adjustment mechanism shown in FIG. 6.

FIGS. 6-8 are perspective illustrations showing an alternate embodiment of a pivot arm 9 and related components incorporating principles of the present invention. More particularly, in the embodiment shown in FIGS. 6-8, a spring adjustment member 30 is preferably arranged along the axis of the spring 22 and a connector (such as a bolt 29*a*', 29*b*') can be permanently affixed to one or more of the angled pieces 19, 21.

Referring first to FIGS. 6-7, in this alternate embodiment, a separate spring adjustment mechanism 30 can be provided to adjust the tension of the spring 22 and hence the force applied to the gate 6 (see FIG. 1). The spring adjustment mechanism 30 can include a bracket 32 having holes 32*b* that receive the steel pin 23. An opposite end of the bracket 32 can include a hole 32*a* that receives an adjustment member 31. The adjustment member 31 can, for instance, be a threaded rod (or all thread). The adjustment member 31 is preferably adjustably connected between the frame 26 and the bracket 32 to adjust the distance between the bracket 32 and the frame 26 and hence the tension on the spring 22. The adjustment member 31 may, for instance, be threadably engaged by a bolt 33*c* permanently affixed to the bracket 32. Additional bolts 33*a*, 33*b* may connect the adjustment member 31 to the frame 26. The spring adjustment mechanism 30 can be used instead of, or in addition to, the adjustment slide 16.

Referring now to FIGS. 6 and 8, a slide adjustment mechanism can also be provided. In this alternate embodiment, one or both of the angled pieces 19, 21 can include a bolt 29*a*', 29*b*' that is permanently affixed (e.g., by welding or other mechanical or chemical attachment) to the respective angled piece 19, 21. Alternatively, an end 15*a* or 15*b* of the all thread 15 can have a bolt 29*a*' or 29*b*' permanently affixed thereto with an opposite end 15*a* or 15*b* of the all thread 15 arranged in another bolt 29*a*' or 29*b*'. The bolts 29*a*', 29*b*', 33*a*, 33*b*, 33*c* are preferably all of the same, standard size so that a single tool can be used to make all the necessary adjustments. The adjustment tool can be provided to a customer purchasing the gate 6.

Having described and illustrated principles of the present invention in various preferred embodiments thereof, it should be apparent that the invention can be modified in arrangement and detail without departing from such principles. I therefore claim all modifications and variations coming within the spirit and scope of the following claims.

The invention claimed is:

1. A manual lift gate assembly, comprising:

a frame;

a pivot arm attached to the frame at a pivot point;

a gate rigidly attached to the pivot arm;

a biasing member connected between the frame and the pivot arm and configured to supply a biasing force to the pivot arm; and a stop arranged on the frame to receive a top portion of the gate when the gate is in the open position, said stop having a substantially wedge-shaped opening configured to receive the top portion of the gate and position the gate in a substantially central location between walls of the frame, wherein said gate and pivot arm are configured to rotate upwardly about the pivot point from a closed position towards an open position and to rotate downwardly about the pivot point from the open position toward the closed position.

2. A gate assembly according to claim 1, further comprising:

a plurality of tension adjustment members for adjusting the amount of biasing force applied by the biasing member.

3. A gate assembly according to claim 2, wherein a first tension adjustment member is arranged between the pivot arm and the biasing member, and wherein a second tension adjustment member is arranged between the biasing member and the frame.

4. A gate assembly according to claim 2, wherein the biasing member comprises a spring and wherein at least one of the tension adjustment members comprises a connector comprising a hole for connecting to an attachment member and a plurality of grooves or threading for adjustably connecting to the biasing member.

5. A gate assembly according to claim 2, wherein one of the tension adjustment members comprises an adjustment bracket and an adjustment rod arranged between the biasing member and the frame.

6. A gate assembly according to claim 1, further comprising an adjustment slide arranged on the pivot arm that permits adjustment of a location of a connection point between the biasing member and the pivot arm.

7. A gate assembly according to claim 1, wherein the pivot point comprises a pin arranged through the pivot arm and a pair of bushings permanently attached to the frame, wherein the bushings each comprise a steel sleeve having a bronze insert.

8. A gate assembly according to claim 1, wherein the gate further comprises an adjustment mechanism arranged between the biasing member and the pivot arm.

9. A gate assembly according to claim 8, wherein the adjustment mechanism comprises a sliding mechanism arranged on the pivot arm in a sliding relationship, wherein sliding movement of the sliding mechanism with respect to the pivot arm adjusts a location where the biasing force acts on the pivot arm.

10. A gate assembly according to claim 8, wherein the biasing member comprises a single spring, said assembly further comprising a spring tension adjustment member arranged between the spring and the frame and a spring tension adjustment member arranged between the spring and the pivot arm.

11. A gate assembly, comprising:

a frame;

a gate and a separately formed pivot arm attached to the gate, wherein said pivot arm is attached to the frame at a pivot point located near a bottom end of the pivot arm, and wherein said gate and pivot arm are configured to rotate upwardly and downwardly about the pivot point;

a biasing member connected between the pivot arm and the frame, wherein said biasing member is configured to apply a biasing force to the gate through the pivot arm; and a stop arranged on the frame to receive a top portion of the gate when the gate is in the open position, said stop having a substantially wedge-shaped opening configured to receive the top portion of the gate and position the gate in a substantially central location between walls of the frame.

12. A gate assembly according to claim 11, further comprising an adjustment mechanism arranged between the biasing member and the pivot arm that enables an amount of the biasing force applied by the biasing member to the gate to be adjusted.

13. A gate assembly according to claim 11, wherein the pivot point is provided by a pin arranged through the pivot arm and further arranged within a bronze insert housed in a steel sleeve permanently affixed to the frame.

14. A gate assembly according to claim 11, further comprising an adjustment mechanism arranged on the pivot arm to adjust a location of the application of the biasing force on the pivot arm.

15. A gate assembly according to claim 14, wherein the adjustment mechanism comprises a sliding member arranged on the pivot arm in a sliding relationship with respect to the pivot arm, such that a location of the sliding member along the pivot arm can be adjusted; wherein the biasing member comprises a spring assembly; and wherein a first end of the spring assembly is connected to the sliding member and a second end of the spring assembly is connected to the frame.

16. A gate assembly comprising:

a gate comprising a pivot arm having a pivot point;

a biasing member configured to apply biasing force to the pivot arm at a connection point;

an adjustment mechanism arranged on he pivot arm to adjust a location of the connection point of the biasing member on the pivot arm; and a stop arranged on a frame to receive a op portion of the gate when the gate is in the open position, said stop having a substantially wedge-shaped opening configured to receive the top portion of the gate and position the gate in a substantially central location between walls of the frame, wherein said gate is configured to rotate upwardly from a closed position toward an open position about the pivot point, and is further configured to rotate downwardly from the open position toward the closed position about the pivot point.

17. A gate assembly according to claim 16, wherein the gate is pivotably attached to the frame at the pivot point.

18. A gate assembly according to claim 17, further comprising an adjustment member arranged between the biasing member and the gate and configured to adjust a biasing force of the biasing member applied to said gate.

19. A gate assembly according to claim 18, further comprising a second adjustment mechanism for adjusting an amount of the biasing force.

* * * * *